US005146911A

United States Patent [19]

Adams

[11] Patent Number: 5,146,911

[45] Date of Patent: Sep. 15, 1992

[54] EXTERIOR ENCLOSURE FOR GAS-FIRED WATER HEATER

[76] Inventor: John W. Adams, 934 Mallard Creek Church Rd. W., Charlotte, N.C. 28262

[21] Appl. No.: 797,702

[22] Filed: Nov. 25, 1991

[51] Int. Cl.[5] ..... F24H 1/00

[52] U.S. Cl. ..... 126/350 R; 126/361; 122/19

[58] Field of Search ..... 126/350 R, 391, 361, 126/344, 307 R, 37 R; 122/264, 367 R, 494, 14, 19

[56] References Cited

U.S. PATENT DOCUMENTS 2,223,769 12/1940 Morrow ..... 122/494
2,371,347 3/1945 Morrow ..... 122/494
3,623,458 11/1971 Block ..... 126/350 R
4,023,558 5/1977 Lazaridis ..... 126/350 R
4,785,792 11/1988 Saint Laurent ..... 126/350 R
4,893,609 1/1990 Giordani et al. ..... 126/350 R

*Primary Examiner*—James C. Yeung
*Attorney, Agent, or Firm*—W. Thad Adams, III

[57] ABSTRACT

An exterior gas-fired water heater enclosure, comprising a base, sidewalls mounted on the base and defining an interior space for receiving a gas-fired water heater, a top positioned on the top of the sidewalls, a flue positioned in the top and communicating with the interior of the enclosure for discharging heated combustion air from the enclosure, vent means positioned adjacent the bottom of the sidewalls for permitting air flow into the enclosure from a point closely proximate a gas burner positioned in the bottom of the water heater, and baffle means positioned over the vent means for directing all of the air flow through the vent downwardly to a position below the gas burner of the water heater.

7 Claims, 5 Drawing Sheets

EXTERIOR ENCLOSURE FOR GAS-FIRED WATER HEATER

TECHNICAL FIELD AND BACKGROUND OF THE INVENTION

This invention relates to an exterior enclosure for a gas-fired water heater. Typically, gas-fired water heaters are placed in basements, utility rooms or closets within a dwelling house. Fire regulations require certain spacing between the water heater and adjacent walls, provision for adequate air flow and ventilation, and specify clearances and angles for the flue pipe which exhausts combustion gases from the water heater. As the cost of gas has become more attractive in relation to the cost of other energy sources such as, for example, fuel oil and electricity, many homeowners with other forms of heat have installed gas water heaters.

In many instances installation of a gas water heater requires an entire closet or utility room of a house be given over to enclosing the water heater, thereby depriving the residents of the room for other purposes. In many other instances, the house may simply not have an area suitable for installation of a gas-fired water heater.

Gas-fired water heaters are also commonly installed by contractors in newly constructed houses. As the size of houses in affordable price ranges has decreased, provision of an area for a gas water-heater in a house inevitably reduces somewhat the livable space within a certain-sized house.

While gas-fired water heaters are extremely safe, gas pipe leaks or unusual malfunctions can cause fire or explosion in rare cases where gas builds up to a certain concentration and is then ignited by a spark.

For all of these reasons it has become advantageous to locate the hot water heater outside the dwelling house, much like central air conditioning units. Because of the safety requirements which must be followed when installing gas appliances and the need to protect the water heater from the weather, this application discloses an enclosure which permits a gas-fired water heater to be safely installed outdoors, thus increasing interior safety and freeing space inside the house for other uses.

SUMMARY OF THE INVENTION

Therefore, it is an object of the invention to provide an exterior water heater enclosure.

It is another object of the invention to provide an exterior water heater enclosure which protects the water heater inside the enclosure from weather.

It is another object of the invention to provide an exterior water heater enclosure which provides proper ventilation to the water heater and proper venting of combustion gases.

It is another object of the invention to provide an exterior water heater enclosure which is easy to fabricate and install.

These and other objects of the present invention are achieved in the preferred embodiments disclosed below by providing an exterior gas-fired water heater enclosure, comprising a base, sidewalls mounted on the base and defining an interior space for receiving a gas-fired water heater, a top positioned on the top of the sidewalls, a flue positioned in the top and communicating with the interior of the enclosure for discharging heated combustion air from the enclosure, vent means positioned adjacent the bottom of the sidewalls for permitting air flow into the enclosure from a point closely proximate a gas burner positioned in the bottom of the water heater, and baffle means positioned over the vent means for directing all of the air flow through the vent downwardly to a position below the gas burner of the water heater.

According to one preferred embodiment of the invention, the sidewalls comprise eight sides.

According to another preferred embodiment of the invention, the sidewalls comprise eight sides, and wherein the eight sides comprise four major sides and four minor sides, the major sides being adjacent to the minor sides at an angle of approximately 45 degrees, pairs of the major sides being in opposing parallel relation to each other and pairs of the minor sides being in opposing parallel relation to each other.

According to yet another preferred embodiment of the invention, the vent means includes a vent positioned in the sidewalls near the top thereof.

Preferably, the base, sidewalls and top are each fabricated from sheet metal.

According to one preferred embodiment of the invention, wherein the major sides are approximately twice the width as the minor sides.

According to another preferred embodiment of the invention, the enclosure includes means for securing the base to a concrete support pad.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
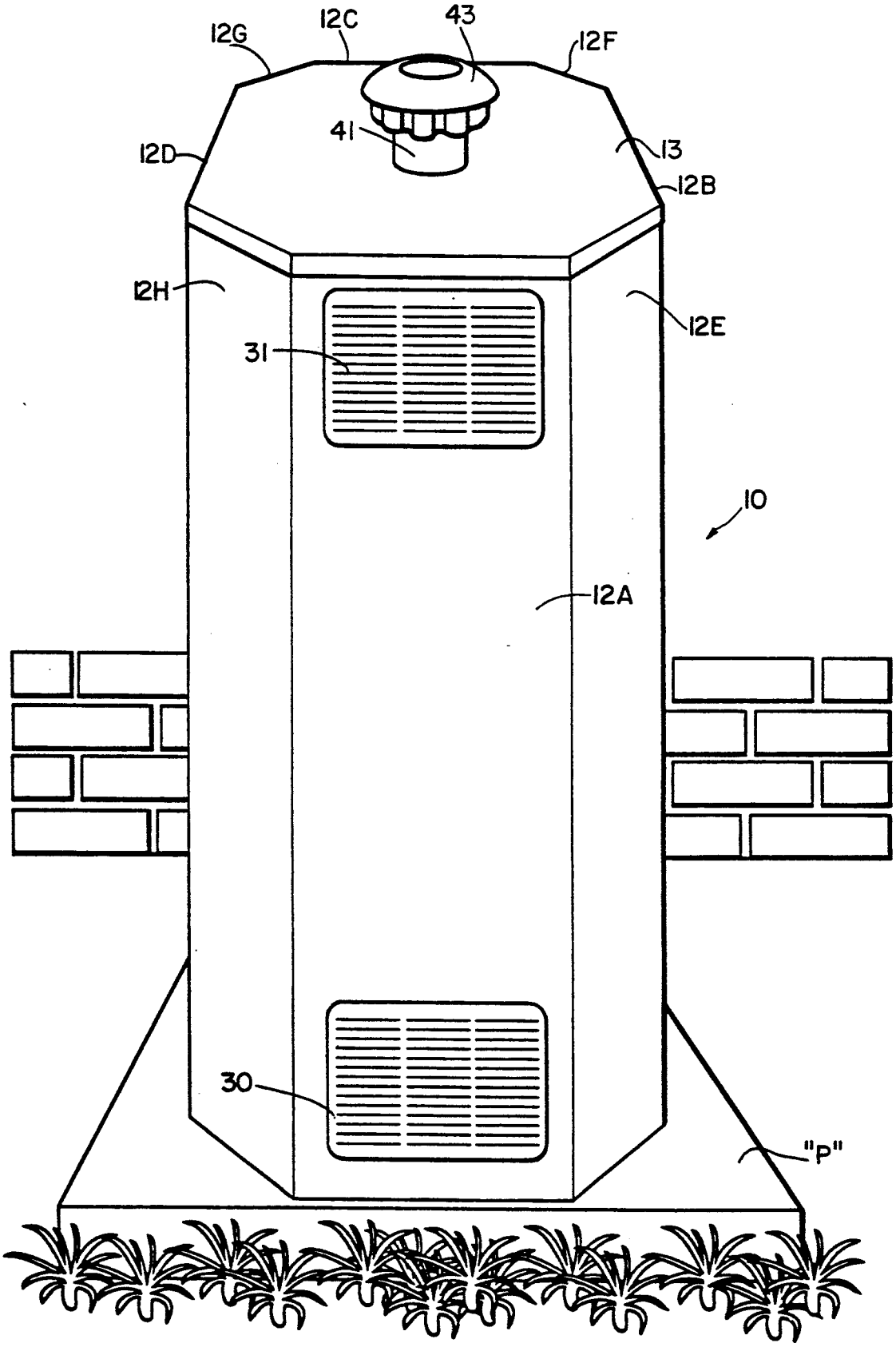
FIG. 1 is an environmental view of the enclosure installed next to a house on a concrete pad.

Referring now specifically to the drawings, an exterior enclosure for a gas-fired water heater according to the present invention is illustrated in FIG. 1 and shown generally at reference numeral 10. As is shown, the enclosure is intended to be mounted on a concrete pad "P" near a side or rear wall of a house. Preferably, the enclosure 10 will be positioned near the gas meter and where supply and hot water delivery pipes may be conveniently piped from and back into the house.

Figure 2:
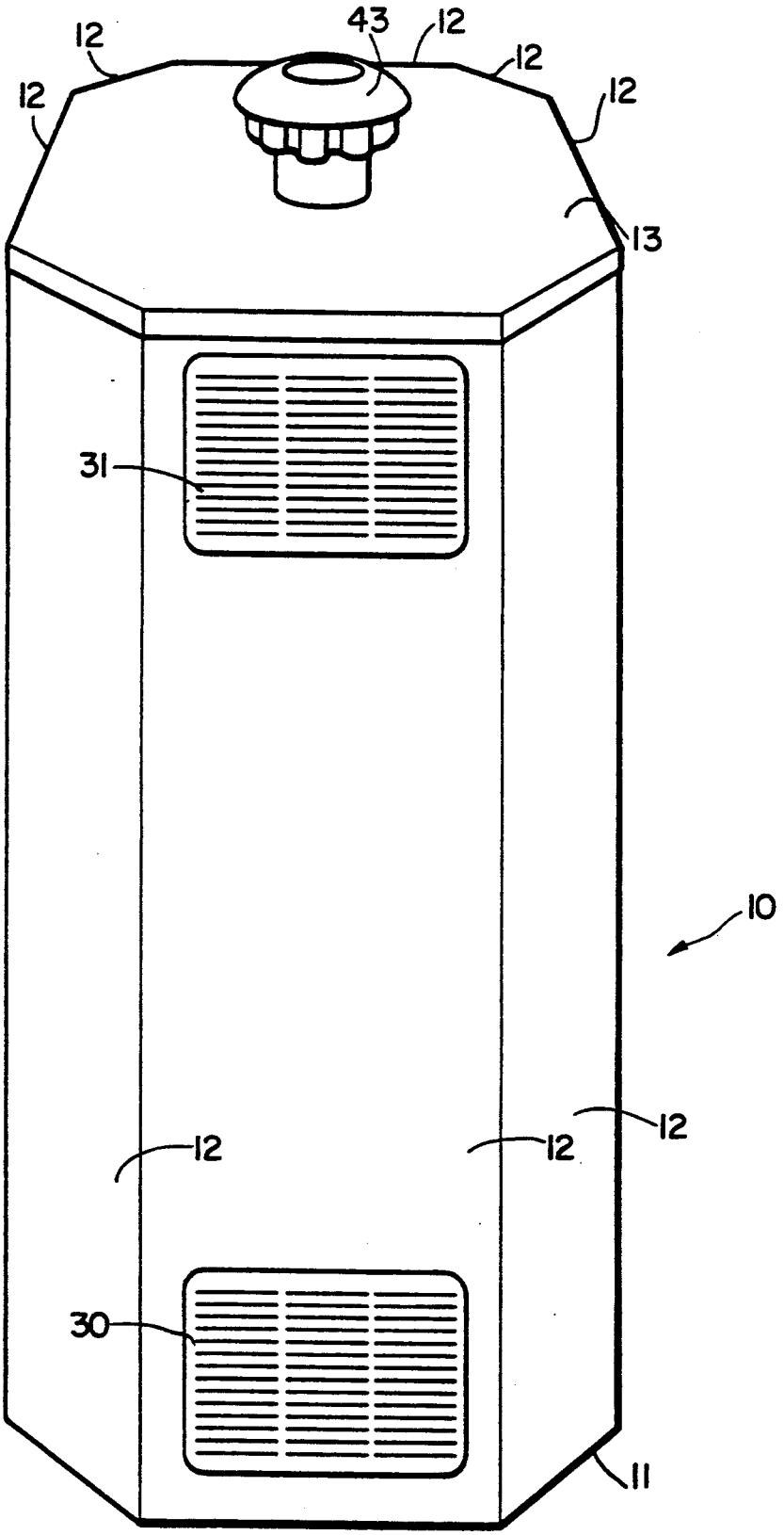
FIG. 2 is a is a perspective view of the enclosure shown in FIG. 1.

As is shown in FIGS. 1 and 2, the enclosure 10 is formed of a base 11 which is secured to the pad "P". The base 11 supports side walls 12 which enclose a water heater 20. Water heater 20 is mounted on the base 11, and gas from a gas supply (not shown) is piped into the enclosure 10 and connected to the gas lines 21 which feed gas to a burner 22. The burner flame applies heat to an insulated tank 23 which holds a supply of water to be heated and kept at a predetermined, thermostatically controlled temperature. Cold supply water is fed to the tank 23 by a supply pipe 24, and heated water is supplied to the house through a hot water delivery pipe 25.

Tank 23 is enclosed within a jacket 26 which comprises the exterior of the hot water heater 23 itself. Heated air and combustion gases flow vertically upwardly along an airspace 28 between tank 23 and jacket 26, supplying additional heat to the sidewalls of the tank 23 and exiting through a hole 29 in the top of the water heater 20.

Figure 3:
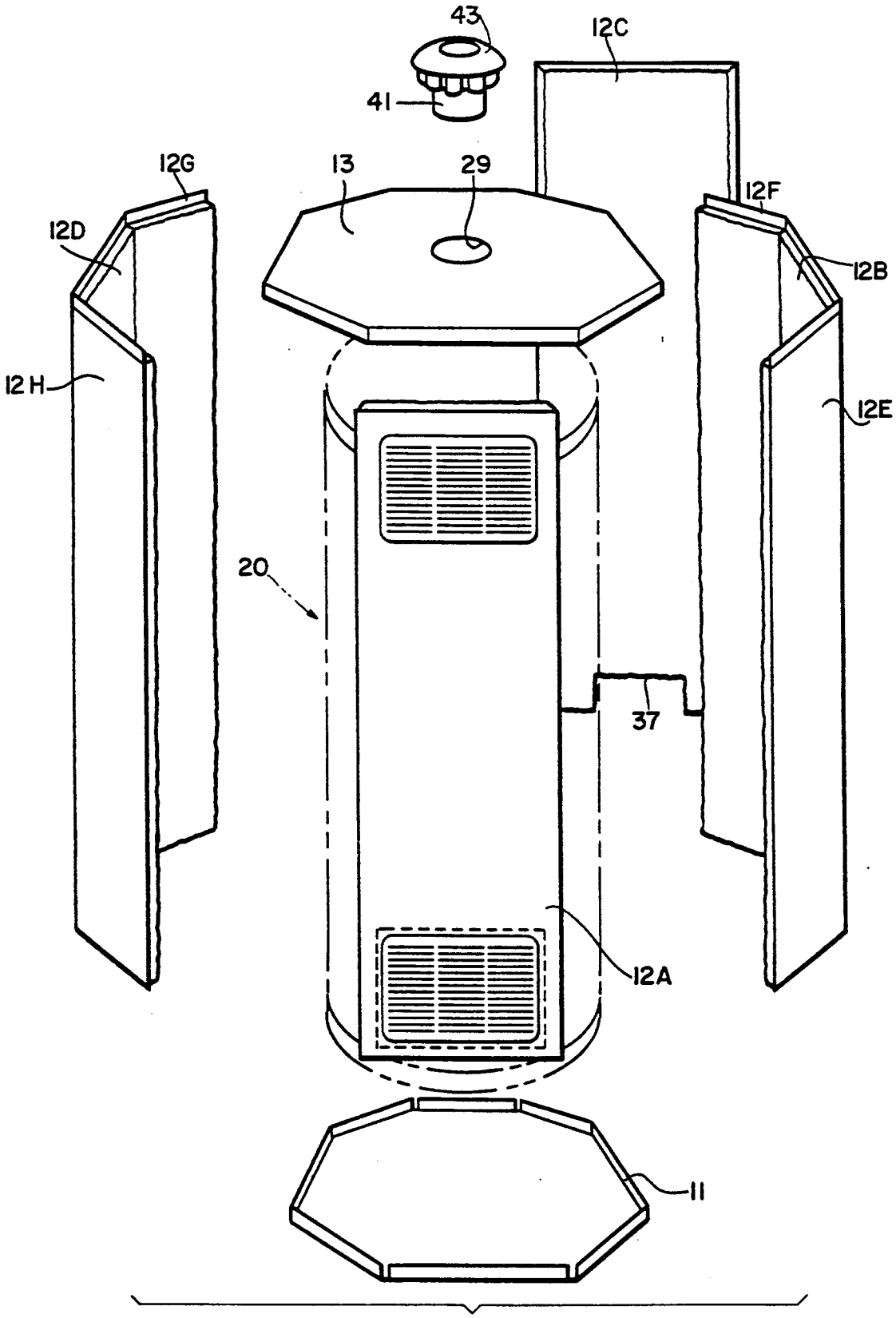
FIG. 3 is an exploded view of the enclosure shown in FIG. 2.

As is best shown in FIG. 3, the sidewalls of the enclosure 10 comprise four relatively large, major walls 12A–12D and four relatively smaller, minor walls 12E–12H. Wall pairs 12A and 12C, 12B and 12D, 12E and 12G, 12F and 12H oppose each other and are parallel with each other.

Figure 4:
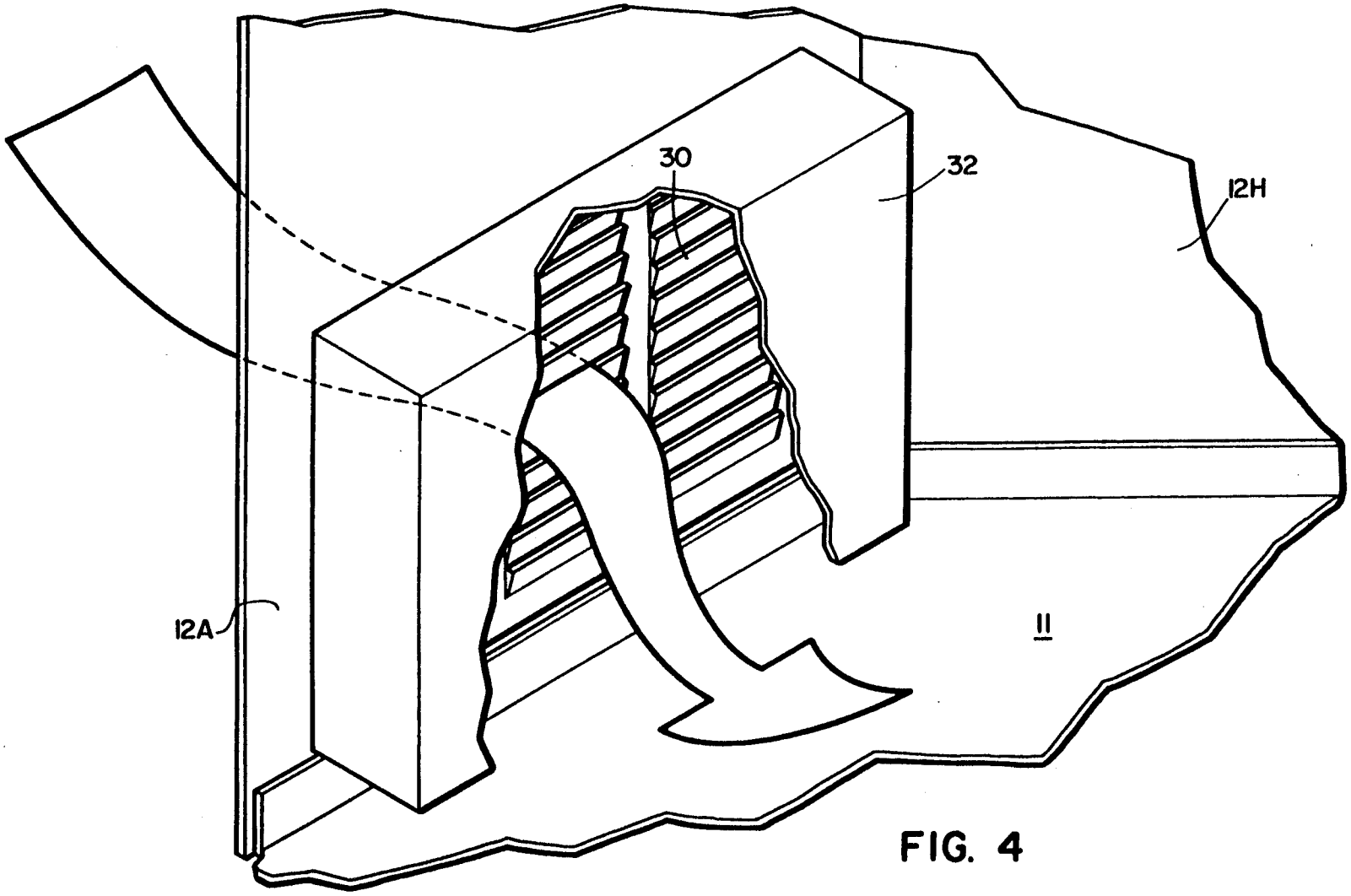
FIG. 4 is a fragmentary, enlarged perspective view of the vent means according to an embodiment of the invention.
Figure 5:
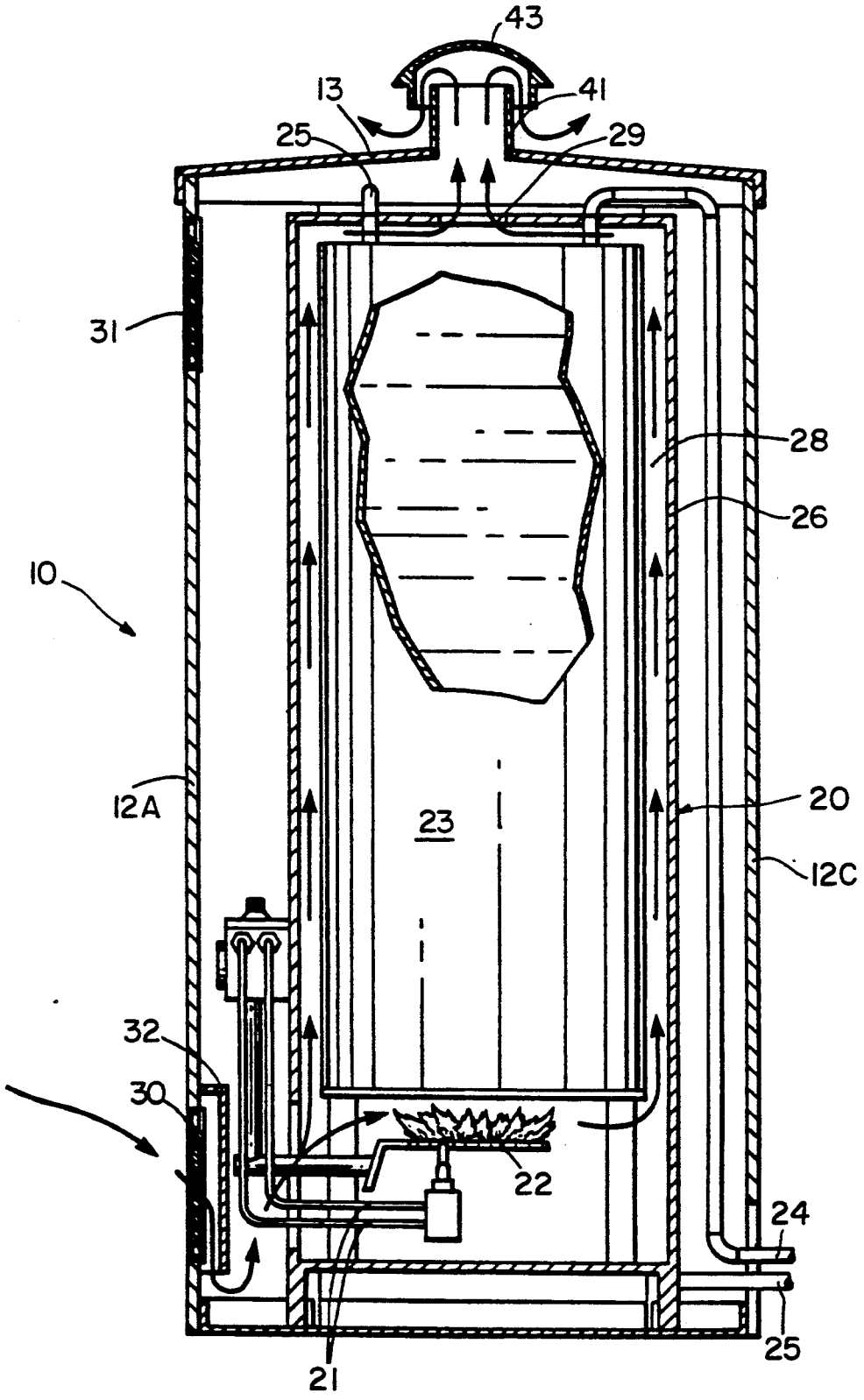
FIG. 5 is a partial vertical cross-section, with parts broken away, of a gas-fired hot water heater installed within an enclosure according to the invention.

Wall 12A is provided with a louvered lower vent 30 and a louvered upper vent 31. Lower vent 30 is baffled with a baffle 32. As is best shown in FIG. 4, baffle 32 comprises a box which encloses the vent 30 and provides only a downwardly directed opening. Air is therefore forced downwardly from the vent, and, as is best shown in FIG. 5, into a position where most of the air can be drawn into the combustion area of the water heater 20 below tank 23.

Wall 12C is provided with a cut-out 37 on its bottom edge to permit passage of water supply and delivery pipes 24 and 25.

Enclosure 10 is enclosed on the top by a top 13 which fits over and is secured to the top edge of the sidewalls 12. Top 40 has a slight draft angle towards the center, where a flue stack 41 is covered by a cover 43. Cover 43 defines a space between itself and the flue stack 41 to permit air and combustion gases to exit, as is shown.

The components of the enclosure 10 are secured together by sheet metal screws. The bottom 11, sidewalls 12 and top 13 are fabricated of 24 gauge sheet steel with a weather resistant finish applied to the outer surface.

Other constructions are possible within the scope of the invention. The enclosure is also suitable for gas fired-hot water furnaces and similar appliances.

An exterior enclosure for a gas-fired water heater is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. An exterior gas-fired storage tank-type water heater enclosure, comprising:

(a) a base;

(b) sidewalls mounted on said base and defining an interior space for receiving a gas-fired water heater including a heated water storage tank;

(c) a top positioned on the top of the sidewalls;

(d) a flue positioned in said top and communicating with the interior of the enclosure for discharging heated combustion air from the enclosure;

(e) vent means positioned adjacent the bottom of the sidewalls for permitting air flow into the enclosure from a point closely proximate a gas burner positioned in the bottom of the water heater; and (f) baffle means positioned over the vent means adjacent the bottom of the side walls, said baffle means comprising a cover having a back, a top, and opposed sides attached to the sidewalls of the enclosure surrounding the vent means and defining a baffle chamber, said baffle chamber having a downwardly directed opening for directing an air flow through the vent downwardly to a position below and sufficiently close to the gas burner of the water heater to be drawn into a combustion zone surrounding the gas burner for mixture with gas introduced into the combustion zone by the gas burner.

2. An exterior water heater enclosure according to claim 1, wherein said sidewalls comprise eight sides.

3. An exterior water heater enclosure according to claim 1, wherein said sidewalls comprise eight sides, and wherein said eight sides comprise four major sides and four minor sides, said major sides being adjacent to said minor sides at an angle of approximately 45 degrees, pairs of said major sides being in opposing parallel relation to each other and pairs of said minor sides being in opposing parallel relation to each other.

4. An exterior water heater enclosure according to claim 1, wherein said vent means includes a vent positioned in the sidewalls near the top thereof.

5. An exterior water heater enclosure according to claim 1, wherein the base, sidewalls and top are each fabricated from sheet metal.

6. An exterior water heater enclosure according to claim 3, wherein said major sides are approximately twice the width as the minor sides.

7. An exterior water heater enclosure according to claim 1, wherein said enclosure includes means for securing the base to a concrete support pad.

* * * * *